US011484065B2

(12) United States Patent
Liu

(10) Patent No.: US 11,484,065 B2
(45) Date of Patent: Nov. 1, 2022

(54) ELECTRONIC CIGARETTE HAVING AN AIR REGULATING RING

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 295 days.

(21) Appl. No.: 16/853,790

(22) Filed: Apr. 21, 2020

(65) Prior Publication Data

US 2021/0153560 A1 May 27, 2021

(30) Foreign Application Priority Data

Nov. 26, 2019 (CN) ..... 201911170295.6
Nov. 26, 2019 (CN) ..... 201922061472.9

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 40/50*** | (2020.01) |
| ***A24F 40/10*** | (2020.01) |
| ***A24F 40/46*** | (2020.01) |
| ***A24F 40/44*** | (2020.01) |

(52) U.S. Cl.
CPC ..... *A24F 40/50* (2020.01); *A24F 40/10* (2020.01); *A24F 40/44* (2020.01); *A24F 40/46* (2020.01)

(58) Field of Classification Search
CPC ..... A24F 40/10; A24F 40/40; A24F 40/44; A24F 40/46; A24F 40/50
See application file for complete search history.

(56) References Cited

U.S. PATENT DOCUMENTS

| | | | | |
|---|---|---|---|---|
| 10,405,582 | B2 * | 9/2019 | Hatton | A24F 40/50 |
| 10,542,780 | B2 * | 1/2020 | Chung | A24F 40/485 |
| 10,865,001 | B2 * | 12/2020 | Atkins | A61M 15/06 |
| 2013/0319407 | A1 * | 12/2013 | Liu | A24F 40/485 128/202.21 |
| 2014/0007891 | A1 * | 1/2014 | Liu | A24F 40/40 131/329 |
| 2014/0060524 | A1 * | 3/2014 | Liu | H05B 3/0014 128/200.14 |
| 2017/0208870 | A1 * | 7/2017 | Liu | A24F 40/485 |
| 2019/0037922 | A1 * | 2/2019 | Liu | H05B 3/44 |
| 2020/0022413 | A1 * | 1/2020 | Zhang | A24F 40/485 |

* cited by examiner

*Primary Examiner* — Abdullah A Riyami
*Assistant Examiner* — Thang H Nguyen
(74) *Attorney, Agent, or Firm* — Matthias Scholl P.C.; Matthias Scholl

(57) ABSTRACT

An electronic cigarette, including: an atomization assembly and a battery assembly. The atomization assembly is disposed on the battery assembly. The atomization assembly includes a mouthpiece, a glass tube, an upper seal ring and a lower seal ring with respect to the glass tube, an atomization body, a first seal ring sealing the atomization body, an air regulating ring including at least one air inlet, a second seal ring sealing the air regulating ring, a plurality of ceramic atomization cores disposed in parallel, a fixed ring fixing the plurality of ceramic atomization cores, a piece of cotton, a base, an insulation ring, and an electrode. The plurality of ceramic atomization cores is fixed on the fixed ring. The piece of cotton is disposed on the bottom of the plurality of ceramic atomization cores to adsorbs leaked condensate. The fixed ring is disposed on the base.

1 Claim, 4 Drawing Sheets

ELECTRONIC CIGARETTE HAVING AN AIR REGULATING RING

CROSS-REFERENCE TO RELATED APPLICATIONS

Pursuant to 35 U.S.C. § 119 and the Paris Convention Treaty, this application claims foreign priority to Chinese Patent Application No. 201911170295.6 filed Nov. 26, 2019 and to Chinese Patent Application No. 201922061472.9 filed Nov. 26, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

Conventional electronic cigarettes are an integrated structure and includes no air regulation device. Thus, the vapor volume is uncontrollable.

SUMMARY

The disclosure provides an electronic cigarette comprising an atomization assembly and a battery assembly. The atomization assembly comprises a mouthpiece, a glass tube, an upper seal ring and a lower seal ring with respect to the glass tube, an atomization body, a first seal ring sealing one end of the atomization body, an air regulating ring including at least one air inlet, a second seal ring sealing the air regulating ring, a plurality of ceramic atomization cores disposed in parallel, a fixed ring fixing the plurality of ceramic atomization cores, a piece of cotton, a base, an insulation ring, and an electrode.

The plurality of ceramic atomization cores is fixed on the fixed ring. The piece of cotton is disposed on the bottom of the plurality of ceramic atomization cores to adsorbs leaked condensate. The fixed ring is disposed on the base. The fixed ring and the base are disposed in the atomization body. The insulation ring is disposed on the bottom of the base to separate the positive and negative pins of the plurality of ceramic atomization cores. The electrode is embedded in the insulation ring. The lower seal ring is disposed on the atomization body to seal the glass tube. The second seal ring is disposed on the bottom of the atomization body to seal the air regulating ring. The air regulating ring is disposed on the bottom of the atomization body. The first seal ring is disposed on the top of the atomization body. The glass tube is disposed on the glass tube. The upper seal ring is disposed in the cavity of the mouthpiece, and the mouthpiece is disposed on the glass tube.

DETAILED DESCRIPTION

To further illustrate, embodiments detailing an electronic cigarette are described below. It should be noted that the following embodiments are intended to describe and not to limit the disclosure.

Figure 1:
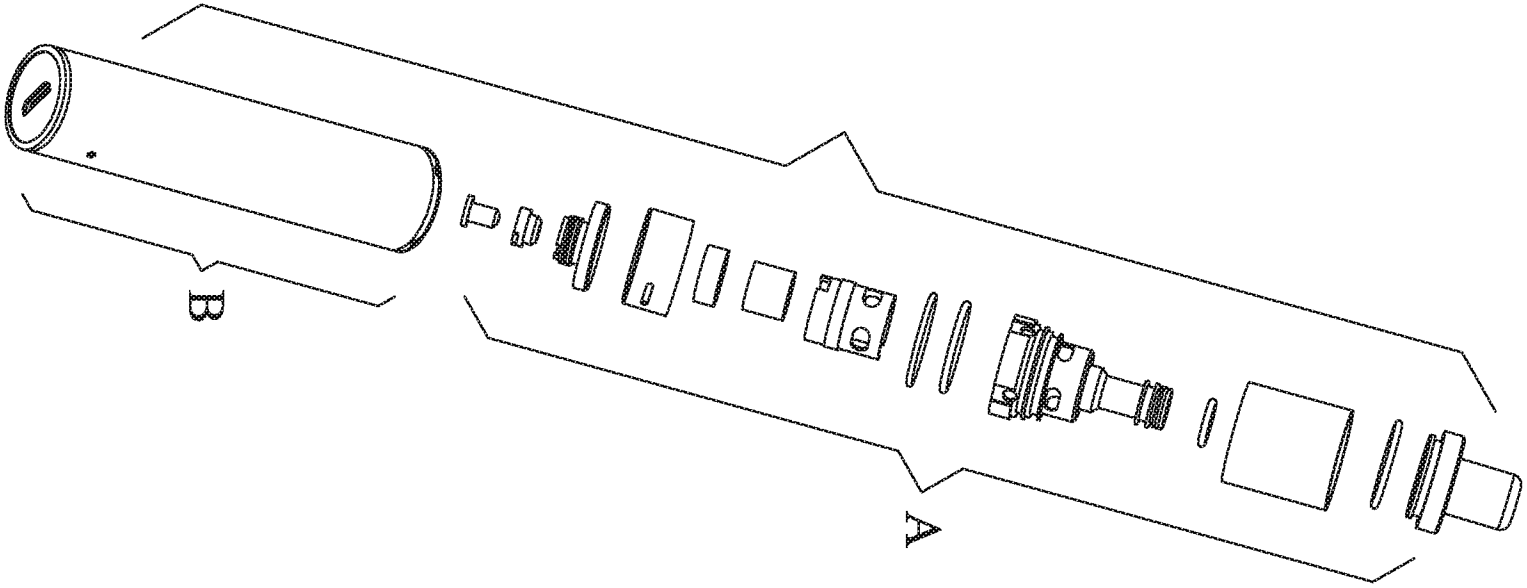
FIG. 1 is an exploded view of an electronic cigarette according to one embodiment of the disclosure.
Figure 2:
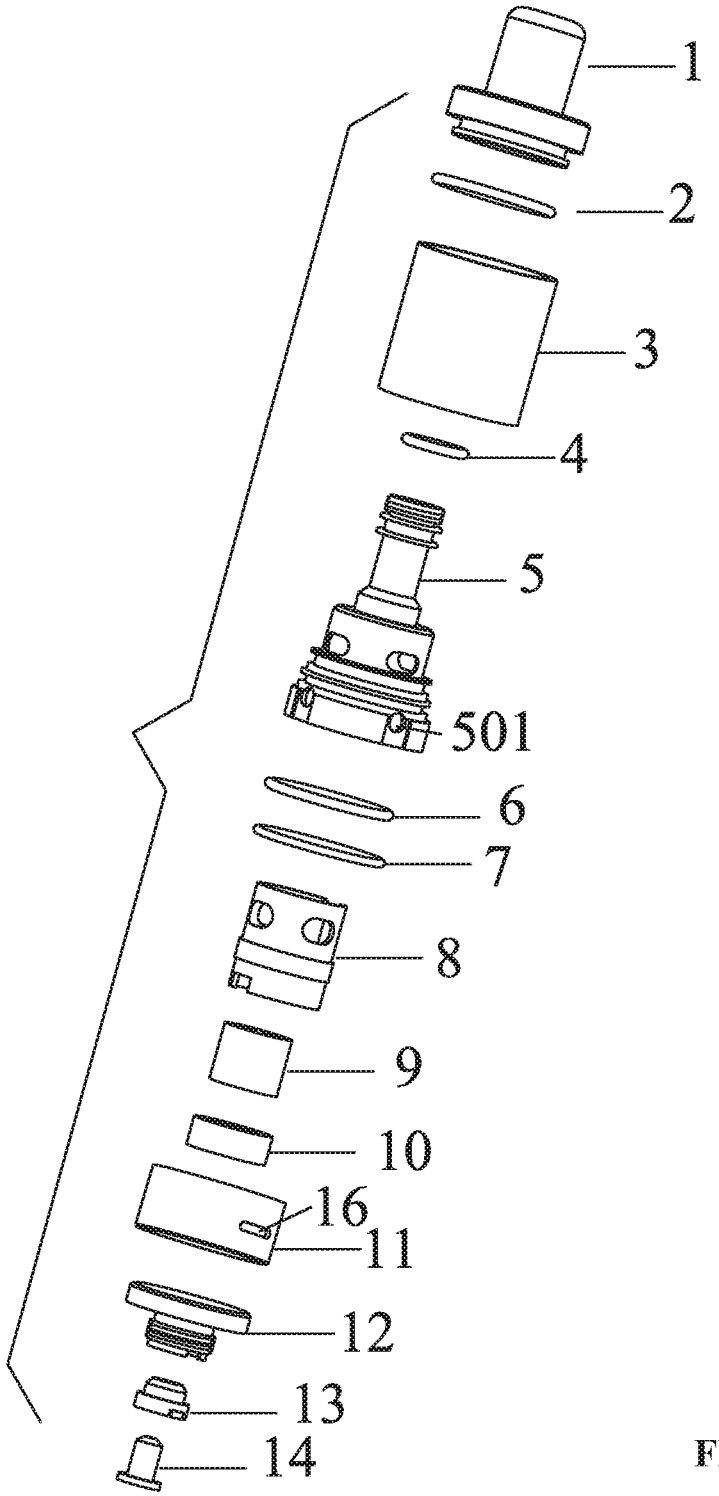
FIG. 2 is an exploded view of an atomization assembly of an electronic cigarette according to one embodiment of the disclosure.
Figure 3:
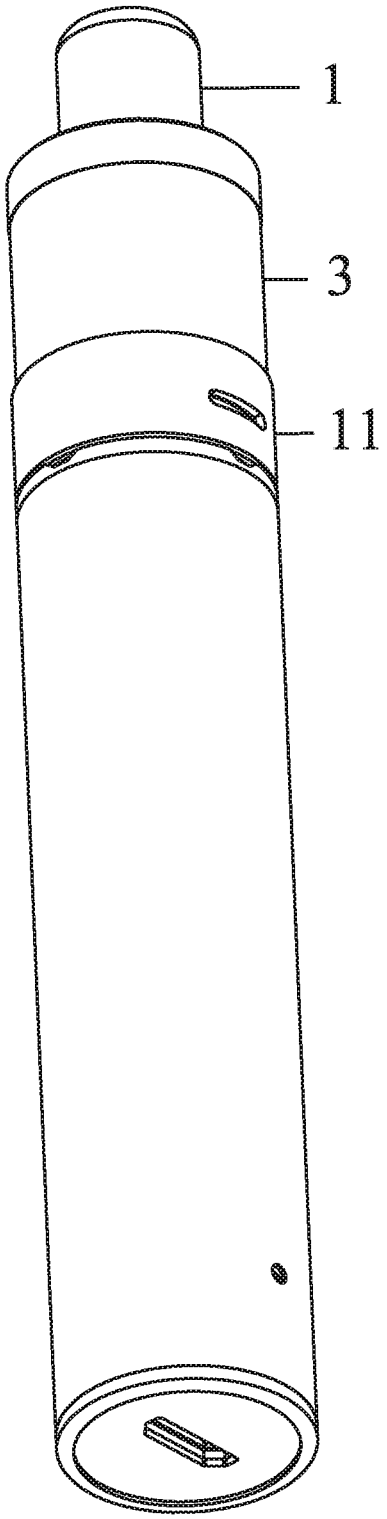
FIG. 3 is a stereogram of an electronic cigarette according to one embodiment of the disclosure.
Figure 4:
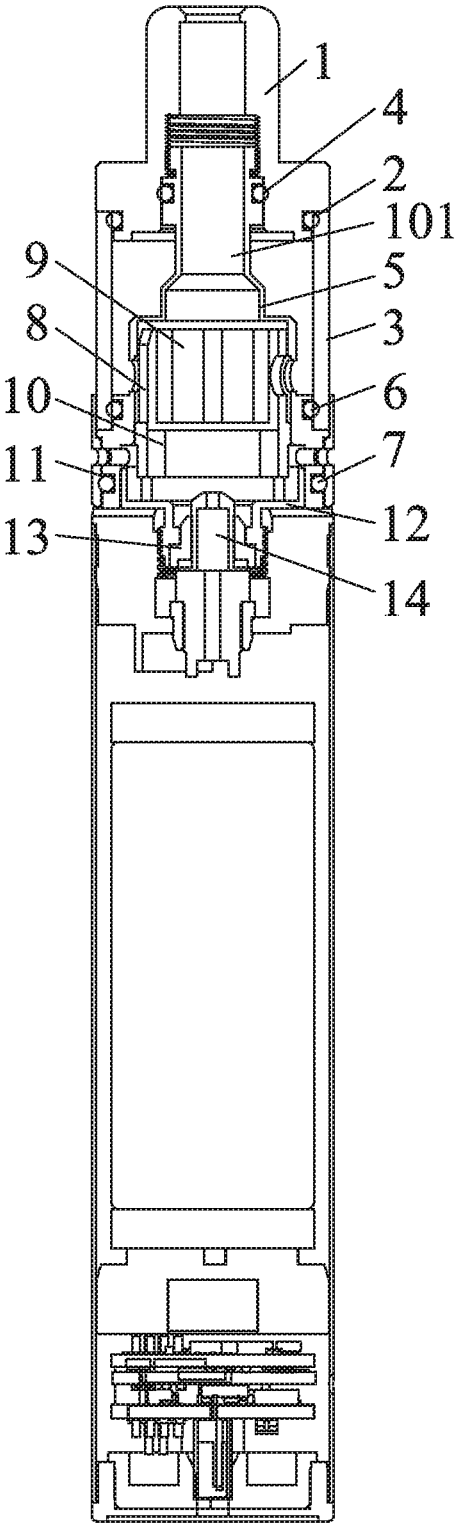
FIG. 4 is a sectional view of an electronic cigarette according to one embodiment of the disclosure.

As shown in FIGS. 1-4, an electronic cigarette comprises an atomization assembly A and a battery assembly B. The atomization assembly A is disposed on the battery assembly B.

The atomization assembly A comprises a mouthpiece 1, a glass tube 3, an upper seal ring 2 and a lower seal ring 6 with respect to the glass tube 3, an atomization body 5, a first seal ring 4 sealing one end of the atomization body 5, an air regulating ring 11, a second seal ring 7 sealing the air regulating ring 11, a plurality of ceramic atomization cores 9, a fixed ring 8 fixing the plurality of ceramic atomization cores 9, a piece of cotton 10, a base 12, an insulation ring 13, an electrode 14, and an air inlet 16 disposed on the air regulating ring 11.

The plurality of ceramic atomization cores 9 is fixed on the fixed ring 8. The piece of cotton 10 is disposed on the bottom of the plurality of ceramic atomization cores 9 to adsorbs leaked condensate. The fixed ring 8 is disposed on the base 12. The fixed ring 8 and the base 12 are disposed in the atomization body 5. The insulation ring 13 is disposed on the bottom of the base 12 to separate the positive and negative pins of the plurality of ceramic atomization cores 9. The electrode 14 is embedded in the insulation ring 13. The lower seal ring 6 is disposed on the atomization body 5 to seal the glass tube 3. The second seal ring 7 is disposed on the bottom of the atomization body 5 to seal the air regulating ring 11. The air regulating ring 11 is disposed on the bottom of the atomization body 5. The first seal ring 4 is disposed on the top of the atomization body 5. The glass tube 3 is disposed on the glass tube 3. The upper seal ring 2 is disposed in the cavity of the mouthpiece 1, and the mouthpiece 1 is disposed on the glass tube 3.

In this disclosure, the atomization body 5 and the air regulating ring 11 form an air regulating unit disposed on the lower part of the atomization assembly A. The side wall of the air regulating ring 11 is provided with the air inlet 16. The atomization body 5 comprises an air channel 101. The lower part of the side wall of the atomization body 5 comprises an air vent 501. The air inlet 16, the air vent 501 and the air channel 101 communicate with each other. Thus, rotating the air regulating ring 11 can control the vapor volume of the electronic cigarette.

The air passes through the air inlet 16, the air vent 501 and the air channel 101 in sequence to enter the atomization body 5. The cooperation of the air inlet 16, the air vent 501 and the air channel 101 can control the vapor volume of the electronic cigarette. The electronic cigarette comprises a plurality of ceramic atomization cores 9 disposed in parallel, so that the ceramic core used in the atomization body has the advantages of smaller resistance value, higher heating power and large vapor volume than conventional ones. In addition, the air vent and the air channel communicate with the cavity of the mouthpiece, which facilitates the release of the bubbles produced when the e-liquid permeates into the ceramic core.

It will be obvious to those skilled in the art that changes and modifications may be made, and therefore, the aim in the appended claims is to cover all such changes and modifications.

What is claimed is:

1. A device, comprising: an atomization assembly and a battery assembly; the atomization assembly being disposed on the battery assembly; and the atomization assembly comprising:

1) A mouthpiece;
2) a glass tube;
3) an upper seal ring and a lower seal ring with respect to the glass tube;
4) an atomization body;
5) a first seal ring sealing one end of the atomization body;
6) an air regulating ring comprising at least one air inlet;
7) a second seal ring sealing the air regulating ring;
8) a plurality of ceramic atomization cores disposed in parallel;
9) a fixed ring fixing the plurality of ceramic atomization cores;
10) a piece of cotton;
11) a base;
12) an insulation ring; and
13) an electrode;

wherein:

the plurality of ceramic atomization cores is fixed on the fixed ring;

the piece of cotton is disposed on a bottom of the plurality of ceramic atomization cores to adsorbs leaked condensate;

the fixed ring is disposed on the base;

the fixed ring and the base are disposed in the atomization body;

the insulation ring is disposed on a bottom of the base;

the electrode is embedded in the insulation ring;

the lower seal ring is disposed on the atomization body to seal the glass tube;

the second seal ring is disposed on a bottom of the atomization body to seal the air regulating ring;

the air regulating ring is disposed on the bottom of the atomization body;

the first seal ring is disposed on the top of the atomization body;

the glass tube is disposed within the air regulating ring and is disposed on the atomization body; and the upper seal ring is disposed in the cavity of the mouthpiece, and the mouthpiece is disposed on the glass tube.

* * * * *